United States Patent [19]

Bensman

[11] 4,388,549

[45] Jun. 14, 1983

[54] PLASMA PLUG

[75] Inventor: Richard W. Bensman, Toledo, Ohio

[73] Assignee: Champion Spark Plug Company, Toledo, Ohio

[21] Appl. No.: 203,270

[22] Filed: Nov. 3, 1980

[51] Int. Cl.[3] ..... H01T 13/20

[52] U.S. Cl. ..... 313/138; 313/143

[58] Field of Search ..... 313/143, 138, 139, 123, 313/142

[56] References Cited

U.S. PATENT DOCUMENTS

| | | | |
|---|---|---|---|
| 2,519,273 | 4/1946 | Mitchel | 123/169 |
| 2,840,742 | 6/1958 | Watters | 313/131 |
| 2,870,376 | 1/1959 | Tognola | 313/123 X |
| 3,911,307 | 10/1975 | Goto et al. | 313/143 |

FOREIGN PATENT DOCUMENTS 2043773 10/1980 United Kingdom .

OTHER PUBLICATIONS

E. F. Lindsley, "More Miles from a Barrel of Crude", Popular Science, Sep. 1979, reproduction on front cover.

*Primary Examiner*—Palmer C. Demeo

*Assistant Examiner*—Sandra L. O'Shea

*Attorney, Agent, or Firm*—John C. Purdue

[57] ABSTRACT

A plasma plug for use with an ignition system with improved plasma jet emmision is disclosed. The plasma plug comprises a threaded shell for engagement with an internal combustion engine, an annular ground electrode structurally integral with the shell, an insulator mounted therein, and a center electrode seated within the insulator. The center electrode and the insulator both have firing ends, the former of which is short of the latter and in spark gap relationship with the ground electrode. The insulator has a stepped cavity extending from the firing end of the electrode through the firing end of the insulator and having a cavity of relatively large cross-section adjacent the former and a cavity of smaller cross-section extending through the latter. The ratio of the volume of the large cavity to that of the smaller is from about 100:1 to about 1:1 and the ratio of the length of the large cavity to that of the smaller is from about 1:3 to about 1:1. The walls in the smaller cavity are electrically insulating and the walls in the large cavity are electrically insulating at least in an upper portion adjacent the firing end of the center electrode.

4 Claims, 4 Drawing Figures

PLASMA PLUG

BACKGROUND OF THE INVENTION

This invention relates to a plasma plug used with a high-energy discharge ignition system to produce a "plasma jet". A typical plasma plug comprises a shell for engagement with an internal combustion engine, an annular ground electrode structurally integral with the shell, an insulator mounted in the shell, and a center electrode seated in a bore of the insulator. The center electrode has a firing end which is in spark gap relationship with the ground electrode. The insulator has a stepped cavity including a cavity of relatively large cross-section adjacent the firing end of the center electrode and a cavity of smaller cross-section axially therebeyond.

A "plasma jet" is emitted when successive high voltage and high current pulses ionize and energize the gap between the electrodes of the plasma plug. The plasma jet is a luminous stream of high-temperature, highly ionized gas with projects longitudinally from the cavity of the insulator into the air-fuel mixture of an internal combustion engine in which the plasma plug is installed. The effectiveness of the plasma jet in causing combustion is partly determined by the length and diameter of its luminous region and the turbulence generated thereby. U.S. Pat. No. 2,840,742, granted June 24, 1958 to Clarence J. Watters, discloses a plasma plug wherein the walls of the stepped cavity are coated with a semi-conductive material.

BRIEF DESCRIPTION OF THE INVENTION

The instant invention is based on the discovery of a plasma plug having improved plasma jet emission. The walls in the smaller cavity are electrically insulating, as are the walls in at least an upper portion of the larger cavity. The walls of the stepped cavity do not require a semi-conductive coating. When the plasma plug is used with a high energy ignition system, e.g. one which can store up to 1.125 joules for discharge with each spark, the ratio of the volume of the larger cavity to that of the smaller is from about 100:1 to about 1:1, and the ratio of the length of the larger cavity to that of the smaller is from about 1:3 to about 1:1. The present plug produces an unexpectedly long and turbulent plasma jet, and, therefore, is unexpectedly effective in causing combustion.

OBJECTS OF THE INVENTION

It is an object of the present invention to provide an improved plasma plug for use with a high energy discharge ignition system.

It is a further object to provide an improved plasma plug having a stepped cavity with walls which do not require a conductive or semi-conductive coating.

DETAILED DESCRIPTION OF THE INVENTION

Figure 1:
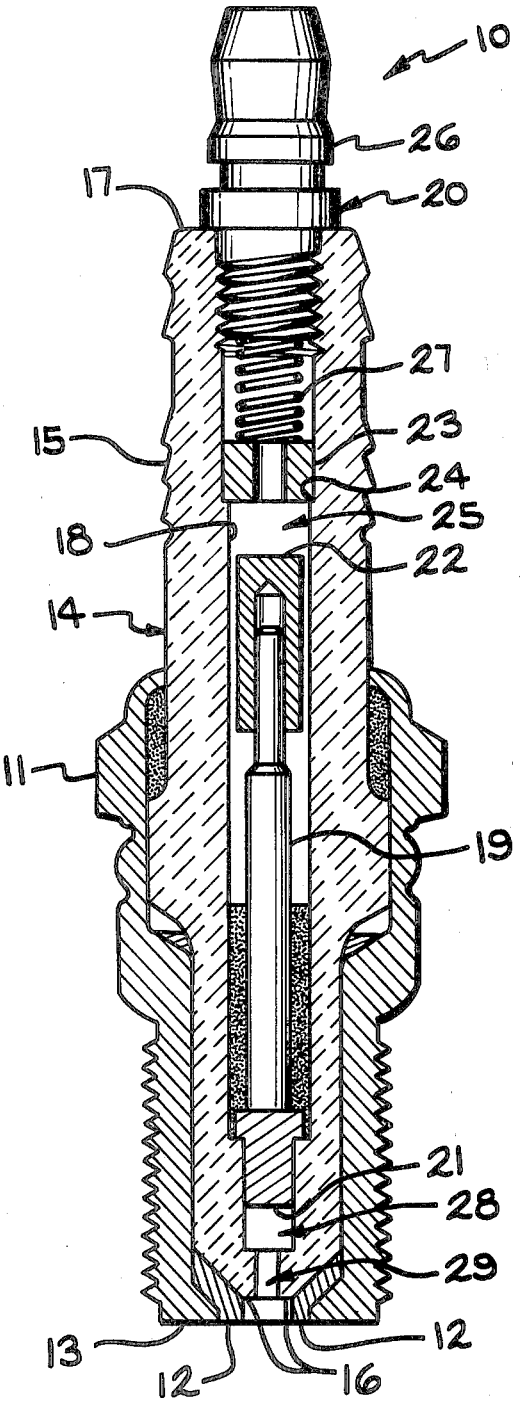
FIG. 1 is a partially schematic, vertical sectional view showing a plasma plug according to the invention.

Referring now in more detail to the drawings, and, in particular, to FIG. 1, a plasma plug indicated generally at 10 comprises a threaded shell 11 for engagement with the head of a cylinder in an internal combustion engine, an annular ground electrode 12 supported by an inwardly directed flange 13 of the shell 11, and an insulator assembly 14 mounted within the shell 11 against the ground electrode 12. The insulator assembly 14 comprises an insulator 15 having firing and terminal ends 16 and 17, respectively, and a bore 18 extending longitudinally therethrough. A center electrode 19 and a terminal assembly 20 are seated in the bore 18, the latter at the terminal end 17 of the insulator 15. The center electrode 19 terminates, at one end, short of the firing end 16 of the insulator 15 in a firing end 21 which is in spark gap relationship with the ground electrode 12, and at the opposite end in terminal electrical contact with an electrode 22. The terminal assembly 20 comprises a sparking contact 23 seated on a step 24 of the bore 18 of the insulator 15 and in spark gap relationship with the electrode 22, the distance therebetween constituting an auxiliary spark gap 25. The assembly 20 also comprises an electrical terminal 26 mounted in the end 17 of the insulator 15 for receiving current from a plasma jet ignition system (not shown in FIG. 1), and a spring 27 interposed between the terminal 26 and the sparking contact 23 to urge the latter yieldingly against the step 24 of the bore 18. The insulator 15 also has a stepped cavity including a cavity 28 of relatively large cross-section adjacent the firing end 21 of the center electrode 19 and of a cavity 29 of smaller cross-section extending through the firing end 16 of the insulator 15.

Figure 2:
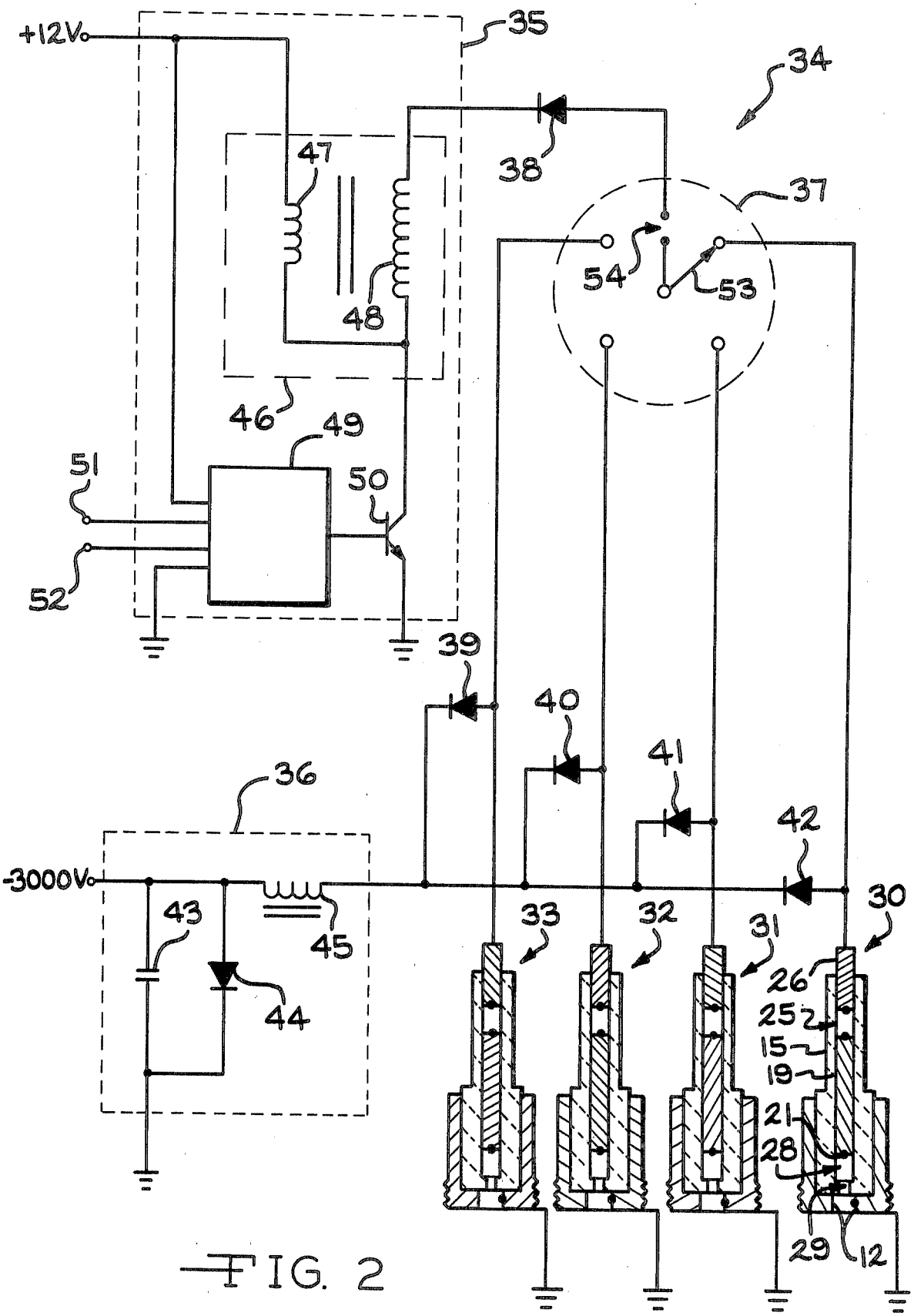
FIG. 2 is a schematic, vertical sectional view of a plurality of plasma plugs of the type shown in FIG. 1 and a schematic representation of an ignition system for applying power thereto.

The plasma plug 10 can be used in a four-cylinder internal combustion engine. Four of those plugs for such use are indicated generally at 30, 31, 32 and 33 in FIG. 2, like components of which are indicated by like reference numerals. The plugs 30, 31, 32 and 33 can be energized by a plasma jet ignition system of the type disclosed by J. R. Asik, et. al., Society of Automotive Engineers, Feb. 28–Mar. 4, 1977, and hereby incorporated by reference. The ignition system, indicated generally at 34 comprises the parallel combination of a conventional inductive ignition system 35 and a high energy capacitive discharge ignition system 36, successively connected to each of the plasma plugs 30, 31, 32 and 33 through a conventional distributor 37. The conventional and high energy ignition systems 35 and 36 are combined by the use of high voltage diodes 38, 39, 40, 41 and 42 which also isolate the two system from one another. Although the high energy ignition system might employ an inductive storage device, the preferred embodiment employs a capacitor 43 to store as much as 1.125 joules. The capacitor 43 is connected to a parallel diode 44 to prevent voltage reversal thereon and to a series inductor 45 to limit the peak value of the current discharged therefrom.

The electronic ignition system 35 comprises a conventional ignition coil 46 including primary and secondary windings 47 and 48, respectively, an ignition trigger 49 and a switching transistor 50. When a twelve volt potential from a conventional vehicle battery (not shown) is applied to the trigger 49, the switching transistor 50 becomes conductive, enabling current to flow from the battery through the primary windings 47 of the ignition coil 46 to establish a magnetic field therein. However, when a pulse is applied at the input terminals 51 and 52 of the trigger 49, the switching transistor 50 becomes nonconductive and interrupts the current in the primary 47, causing the magnetic field to collapse.

The distributor 37 has a rotor arm 53 which, when in the position shown, electrically connects a spark gap 54 therein to the terminal 26 of the plasma plug 30. When the magnetic field of the coil 46 collapses, current flow is induced through the secondary windings 48 and the diode 38 to produce a high negative voltage across the serially connected distributor gap 54, the auxiliary gap 25 of the plug 30, and the stepped cavity of the plug 30 between the ground electrode 12 and the firing end 21 of the center electrode 19. The high negative voltage ionizes all three gaps causing a spark discharge therethrough and enables the energy stored in the capacitor 43 of the high energy ignition system 36 to be dumped into the stepped cavity of the plug 30 through the inductor 45, the diode 42, the terminal 26 and auxiliary gap 25 of the plug 30. The auxiliary gap 25 prevents current leakage which would cause premature discharge of the storage capacitor 43. An auxiliary gap outside the spark plugs 30, 31, 32 and 33 could also be used in lieu of the internal auxiliary gap 25 disclosed herein, as could additional triggering apparatus for the high energy discharge ignition system 36. The plugs 31, 32 and 33 fire successively in a similar manner as the rotor 53 rotates clockwise from the position shown.

If a sufficient amount of energy is delivered to the stepped cavity of the plug 30 in a short enough period of time, a plume projects longitudinally from the stepped cavity into the air-fuel mixture of the combustion chamber. Increasing the length and diameter of the plume and the turbulence generated thereby enhances the effectiveness of the plug 30. Therefore, the high energy ignition system 36 is matched to the physical dimensions of the stepped cavity of the plug 30 to provide optimum effectiveness. For example, the stepped cavity of the insulator 15 is composed of a cavity 28 is 0.100 inch in diameter and a cavity 29 which is 0.040 inch in diameter, while the lengths of the cavities 28 and 29 are 0.050 inch and 0.100 inch, respectively. The electrical characteristics of the ignition system 36 are matched to these dimensions, a volume ratio of the large cavity 28 to the smaller cavity 29 being 12.5:1 and a length ratio of the larger cavity 28 to the smaller cavity 29 being 1:2, to optimize combustive effectiveness. Adequate matching is accomplished when the capacitor 43 has a value of 0.25 microfarads and is charged to three kilovolts for a maximum stored input energy of 1.125 joules.

This amount of energy approaches a maximum suitable for applications involving internal combustion engines because of the high temperatures generated within the plasma plug 10 (FIG. 1) and the electrical erosion of electrodes. The ground electrode 12, the firing end 21 of the center electrode 19, the electrode 22 and the contact 23 of the plug 10 are all fabricated from wrought tungsten, a tungsten alloy or other erosion-resistant material. The maximum energy also limits the magnitude of the volume and length ratios of the cavities 28 and 29. An excessively large volume ratio or an excessively small length ratio prevents the storage capacitor 43 (FIG. 2) in the ignition system 36 from discharging to generate a plume. If the volume ratio is excessively small or the length ratio is excessively large, the turbulence generated by the plume becomes too weak to sustain effective combustion. Accordingly, the volume ratio should be from about 100:1 to about 1:1 and the length ratio should be from about 1:3 to about 1:1.

The plume projected from the stepped cavity of the plug 30 comprises not only a jet of plasma, a luminous stream of high-temperature gas, but also a portion of the spark generated by the ignition systems 35 and 36 between the ground electrode 12 and the firing end 21 of the center electrode 19. The force of the plasma ejected through the smaller cavity 29 causes that portion of the spark to be diverted into the combustion chamber as part of the plume. Since plasma ignition provides a more efficient combustion than does spark ignition, it is desirable that the plume consists primarily of plasma.

Figure 3:
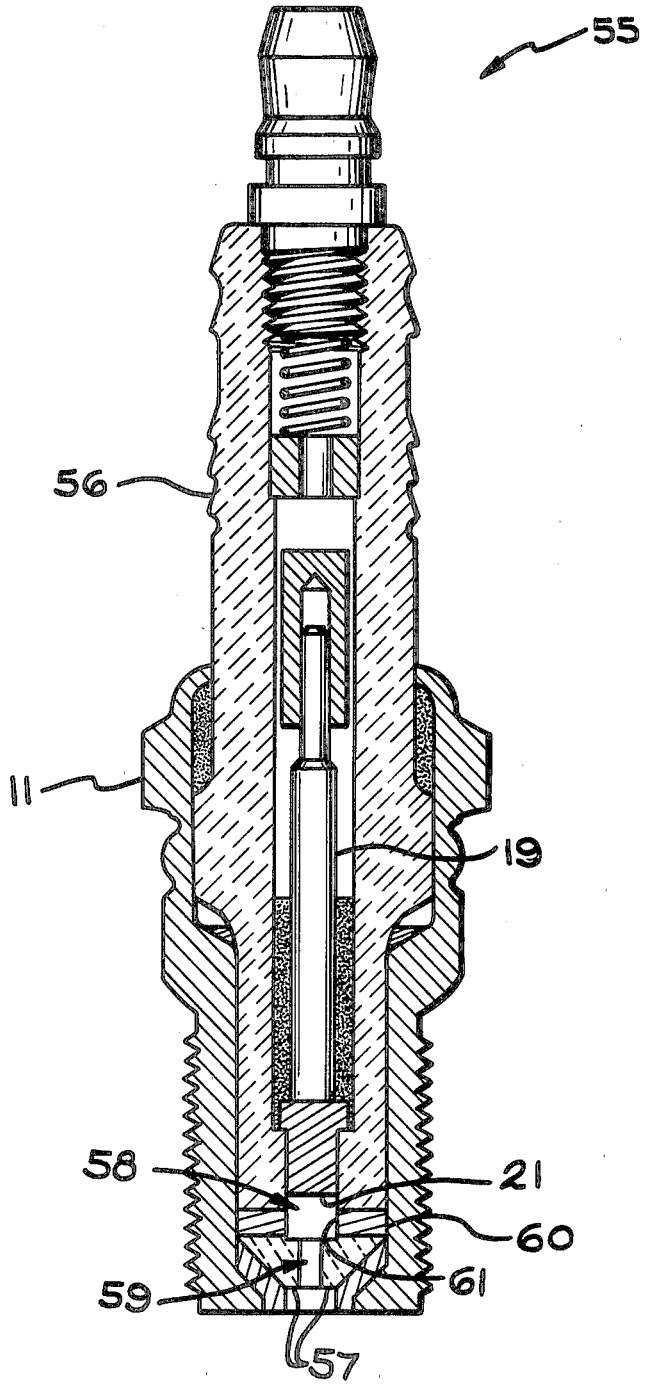
FIG. 3 is a sectional view similar to FIG. 1 showing another embodiment of a plasma plug according to the invention.

A modification of the plasma plug 10 of FIG. 1 is indicated generally at 55 in FIG. 3. The plasma plug 55 has a modified insulator 56, but, as indicated by the use of like reference numerals, is otherwise the same as the plasma plug 10 (FIG. 1). The insulator 56 (FIG. 3) has a firing end 57 and a stepped cavity including a cavity 58 of relatively large cross-section adjacent the firing end 21 of the center electrode 19 and a cavity 59 of smaller cross-section extending through the firing end 57 of the insulator 56. An annular auxiliary electrode 60 is seated within the insulator 56 in electrical contact with the shell 11. The electrode 60 has an inner annular surface 61 which forms an electrically conductive wall in a lower portion of the large cavity 58 adjacent the smaller cavity 59, while the walls in the upper portion of the large cavity 58 adjacent the firing end 21 of the center electrode 19 and those in the smaller cavity 59 remain electrically insulating. The position of the conductive walls with respect to the firing end 11 of the center electrode 19 not only shortens the spark path, thereby reducing the voltage required to break down the gap within the stepped cavity of the insulator 56, but also directs the spark from the ignition systems 35 and 36 radially outwardly to avoid the walls of the smaller cavity 59, thereby preventing the spark from being ejected from the cavity as part of the plume. Consequently, the plume projected from the stepped cavity of the insulator 56 of the plug 55 is primarily plasma.

Figure 4:
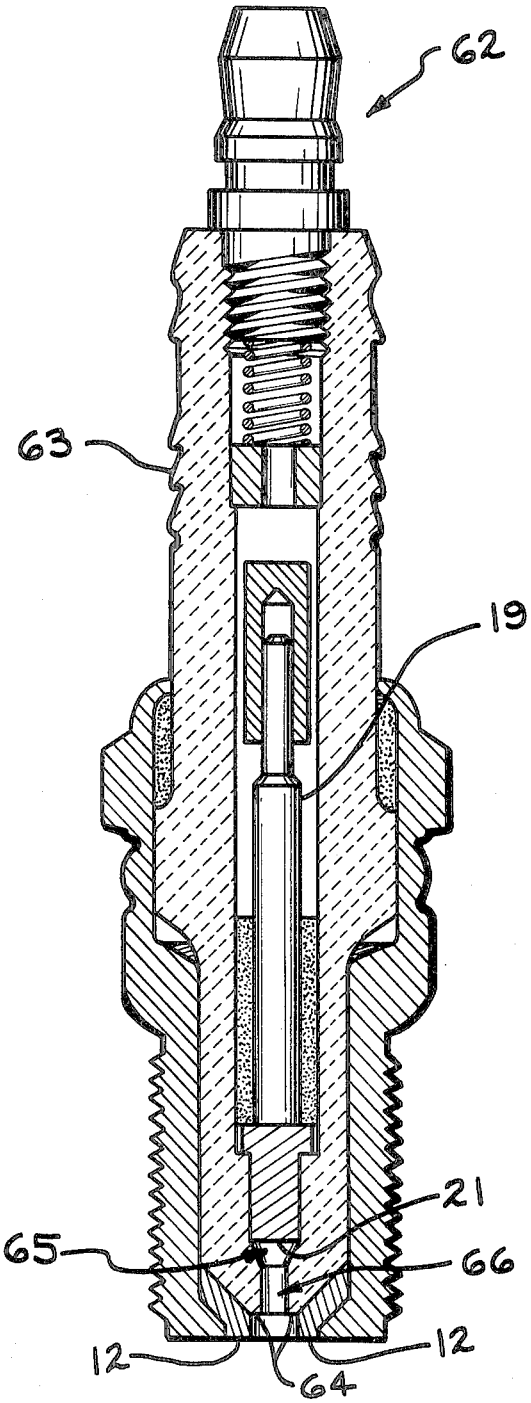
FIG. 4 is a sectional view similar to FIG. 1 showing still another embodiment of a plasma plug according to the invention.

Another modification of the plasma plug 10 of FIG. 1 is indicated generally at 62 in FIG. 4. The plasma plug 62 has a modified insulator 63, but, as indicated by the use of like reference numerals, is otherwise the same as the plasma plug 10 (FIG. 1). The insulator 63 (FIG. 4) has a firing end 64 and a stepped cavity including a conical cavity 65 of relatively large cross-section adjacent the firing end 21 of the center electrode 19 and tapering radially inwardly to a cavity 66 of smaller cross-section extending through the firing end 64 of the insulator 63. The position of the firing end 21 with respect to the ground electrode 12 shortens the spark path therebetween, thereby reducing the voltage required to break down the gap within the cavity of the insulator 63.

It will be apparent that various changes may be made in details of construction from those shown in the attached drawings and discussed in conjunction therewith without departing from the spirit and scope of this invention as defined in the appended claims. It is, therefore, to be understood that this invention is not to be limited to the specific details shown and described.

What I claim is:

1. A plasma plug for use with an ignition system which, when energized, applies to the plug a high voltage ionizing discharge followed by a lower voltage, high energy discharge, said plug comprising a shell engagable with an internal combustion engine, an annular ground electrode structurally integral with said shell, an insulator mounted in said shell, and a center electrode seated within said insulator, said center electrode and said insulator both having firing ends, the former of which is short of the latter and in spark gap relationship with said ground electrode, said insulator having a stepped cavity extending from the firing end of said center electrode through the firing end of said insulator, the stepped cavity including a cavity of relatively large cross section and a cavity of smaller cross section extending through the firing end of said insulator, the large cavity having an upper portion adjacent the firing end of said center electrode and a lower portion adjacent the smaller cavity, the ratio of the volume of the large cavity to that of the smaller being from about 100:1 to about 1:1, and the ratio of the length of the large cavity to that of the smaller being from about 1:3 to about 1:1, whereby a jet of plasma is emitted generally longitudinally from the cavity of said insulator when the plug is energized by successive high voltage and high energy discharges.

2. A plasma plug as recited in claim 1 wherein the large cavity is cylindrical.

3. A plasma plug as recited in claim 2 wherein the walls in the smaller cavity are electrically insulating and the walls in the large cavity are electrically insulating in at least the upper portion adjacent the firing end of the center electrode.

4. A plasma plug as recited in claim 1 wherein the large cavity is conical and tapers radially inwardly toward the smaller cavity.

* * * * *